US007950174B2

(12) United States Patent
Xu

(10) Patent No.: US 7,950,174 B2
(45) Date of Patent: May 31, 2011

(54) WINDPROOF BILLBOARD

(76) Inventor: Peiyuan Xu, Ningbo (CN)

( * ) Notice: Subject to any disclaimer, the term of this patent is extended or adjusted under 35 U.S.C. 154(b) by 7 days.

(21) Appl. No.: 12/622,467

(22) Filed: Nov. 20, 2009

(65) Prior Publication Data

US 2010/0122481 A1 May 20, 2010

(30) Foreign Application Priority Data

Nov. 20, 2008 (CN) ..... 2008 2 0168536 U

(51) Int. Cl.
*G09F 15/00* (2006.01)

(52) U.S. Cl. ..... 40/624; 248/284.1

(58) Field of Classification Search ..... 248/284.1; 40/624, 601, 612, 217
See application file for complete search history.

(56) References Cited

U.S. PATENT DOCUMENTS 2,221,606 A * 11/1940 Piacentini ..... 40/217
2,746,187 A * 5/1956 Ennever ..... 40/624
3,235,214 A * 2/1966 Sprung ..... 248/158
6,886,701 B2 * 5/2005 Hong et al. ..... 211/99

* cited by examiner

*Primary Examiner* — Joanne Silbermann
*Assistant Examiner* — Shin Kim
(74) *Attorney, Agent, or Firm* — Matthias Scholl P.C.; Matthias Scholl

(57) ABSTRACT

A windproof billboard, including at least a body, a pair of first supports, multiple second supports, a rotating shaft, multiple linkage mechanisms, a transmission mechanism, a power mechanism, and at least one brake, wherein the first supports and the second supports are disposed on the ground, the bottom of the body is hinge connected to the first supports, the linkage mechanisms are hinge connected an upper part of the back of the body and fixed on the rotating shaft, and operate to drive the body to rotate with respect to the first supports, the rotating shaft abuts against one of the second supports, the power mechanism is fixed on the transmission mechanism and operates to drive the rotating shaft to rotate via the transmission mechanism, and the brake is disposed on one of the second supports and operates to fix the rotating shaft.

17 Claims, 5 Drawing Sheets

WINDPROOF BILLBOARD

CROSS-REFERENCE TO RELATED APPLICATIONS

Pursuant to 35 U.S.C. §119 and the Paris Convention Treaty, this application claims the benefit of Chinese Patent Application No. 200820168536.4 filed on Nov. 20, 2008, the contents of which are incorporated herein by reference.

BACKGROUND OF THE INVENTION

1. Field of the Invention

The invention relates to a billboard, and more particularly to a windproof billboard.

2. Description of the Related Art

Billboards are widely used nowadays. However, there are several problems with the existing billboards: firstly, windward area thereof cannot be changed, and thus wind act cannot be eliminated and the billboards are easy to be destroyed by strong wind; moreover, in a condition of strong wind, the billboards cannot immediately return to original positions.

SUMMARY OF THE INVENTION

In view of the above-described problem, it is one objective of the invention to provide a windproof billboard having a variable windward area and thus can eliminate wind act, and capable of immediately retuning to an original position in a condition of strong wind.

To achieve the above objectives, in accordance with one embodiment of the invention, provided is a windproof billboard, comprising a body, a pair of first supports, multiple second supports, a rotating shaft, multiple linkage mechanisms, a transmission mechanism, a power mechanism, and at least one brake, wherein the first supports and the second supports are disposed on the ground, the bottom of the body is hinge connected to the first supports, the linkage mechanisms are hinge connected an upper part of the back of the body and fixed on the rotating shaft, and operate to drive the body to rotate with respect to the first supports, the rotating shaft abuts against one of the second supports, the power mechanism is fixed on the transmission mechanism and operates to drive the rotating shaft to rotate via the transmission mechanism, and the brake is disposed on one of the second supports and operates to fix the rotating shaft.

In a class of this embodiment, the linkage mechanism comprises a connecting rod and a rocker, and rotation of the rotation shaft drives the rocker and the connecting rod to swing.

In a class of this embodiment, one end of the connecting rod is hinge connected an upper part of the back of the body, the other end of the connecting rod is hinge connected to one end of the rocker, and the other end of the rocker is fixed on the rotating shaft.

In a class of this embodiment, the transmission mechanism comprises a chain and a chain wheel engaged with each other.

In a class of this embodiment, the brake is an electromagnetic brake.

In a class of this embodiment, the power mechanism is a crank.

In accordance with another embodiment of the invention, provided is a windproof billboard, comprising a body, a pair of first supports, multiple second supports, a rotating shaft, multiple linkage mechanisms, a transmission mechanism, a power mechanism at least one brake, a first trigger switch, an anemometer, and an electrical control device, wherein the first supports and the second supports are disposed on the ground, the bottom of the body is hinge connected to the first supports, the linkage mechanisms are hinge connected an upper part of the back of the body and fixed on the rotating shaft, and operate to drive the body to rotate with respect to the first supports, the rotating shaft abuts against one of the second supports, the power mechanism is fixed outside the rotating shaft and operates to drive the rotating shaft to rotate via the transmission mechanism, the brake is disposed on one of the second supports and operates to fix the rotating shaft, the anemometer is disposed on the body or on the ground, and operates to measures a wind velocity, the first trigger switch is disposed between one of the second supports and the body, and operates to detect whether the body is in a horizontal position, and the electrical control device is electrically connected to the brake, the power mechanism, the anemometer and the first trigger switch, and operates to control the power mechanism and the brake according to a wind velocity measured by the anemometer and a control signal of the first trigger switch.

In a class of this embodiment, the linkage mechanism comprises a connecting rod and a rocker, and rotation of the rotation shaft drives the rocker and the connecting rod to swing.

In a class of this embodiment, it further comprises a second trigger switch disposed between the connecting rod and the rocker, electrically connected to the electrical control device, and operating to detect whether the body is in a vertical position.

In a class of this embodiment, one end of the connecting rod is hinge connected an upper part of the back of the body, the other end of the connecting rod is hinge connected to one end of the rocker, and the other end of the rocker is fixed on the rotating shaft.

In a class of this embodiment, the transmission mechanism comprises a chain and a chain wheel engaged with each other.

In a class of this embodiment, the brake is an electromagnetic brake.

In a class of this embodiment, the power mechanism is a motor.

In a class of this embodiment, the first trigger switch comprises a stopper and a limit switch, the limit switch is connected to the electrical control device, the stopper is fixed on one of the body and one of the second supports, and the limit switch is fixed on the other one of the body and one of the second supports.

In a class of this embodiment, the electrical control device comprises a main control unit and a signal conversion unit, the main control unit is electrically connected to the brake, the power mechanism and the first trigger switch, and the anemometer is connected to the main control unit via the signal conversion unit.

In a class of this embodiment, it further comprises a first relay and a second relay.

In a class of this embodiment, the first relay operates to drive the power mechanism to rotate forwardly, and the second relay operates to drive the power mechanism to rotate reversely.

Advantages of the invention comprise:

1) the brake and the power mechanism make it possible to manually eliminate wind act.

2) the anemometer and the electrical control device make it possible for the windproof billboard to change windward area according to a wind velocity and to totally eliminate wind act, which makes use of the windproof billboard more safe.

3) the motor makes it possible for the windproof billboard to immediately return to an original vertical position as measured a wind velocity is less than preset a wind velocity, and thus the windproof billboard features good controllability and advertisement effect and is safe for use.

4) during design of the windproof billboard, only wind act under normal weather condition needs to be taken into account, and thus dimension and strength of materials for making the windproof billboard are decreased, which reduces production cost.

5) since the windproof billboard can rotates to a horizontal position and be fixed, if a curtain of the windproof billboard needs to be changed or maintained, work spent on exterior wall of high buildings is reduced, and safety during maintenance is improved.

BRIEF DESCRIPTION OF THE DRAWINGS

The invention is described hereinafter with reference to accompanying drawings, in which.

DETAILED DESCRIPTION OF THE EMBODIMENTS

Figure 1:
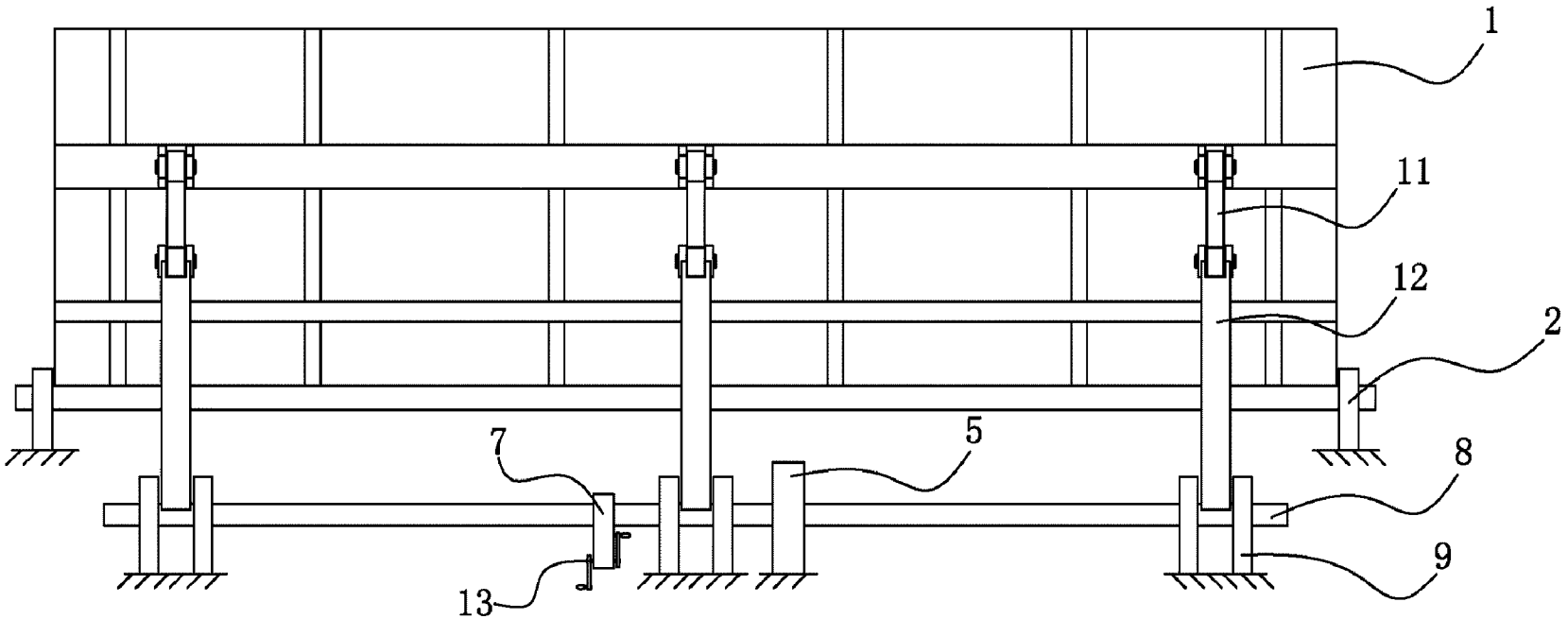
FIG. 1 is a schematic view of a windproof billboard of an exemplary embodiment of the invention.
Figure 2:
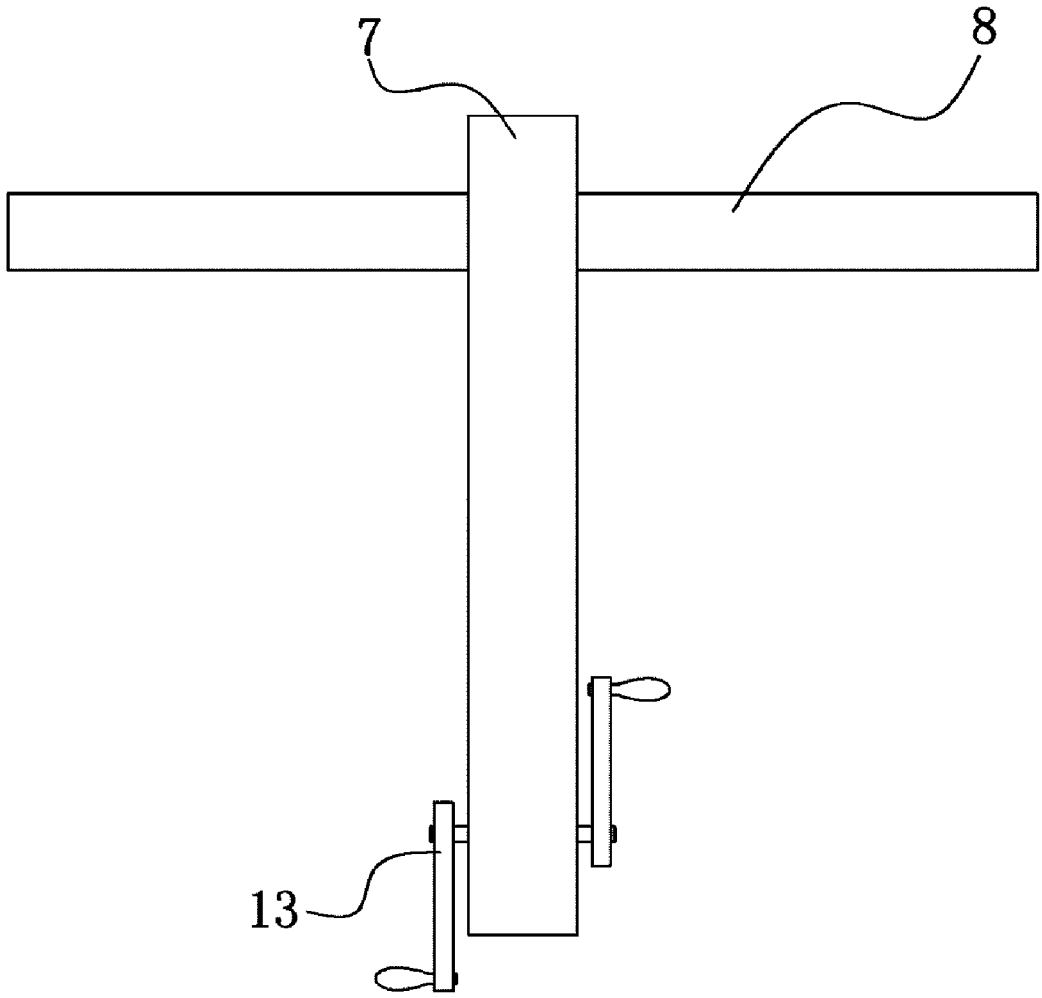
FIG. 2 is a schematic view of a transmission mechanism of a windproof billboard of FIG. 1.

As shown in FIGS. 1-2, a windproof billboard of a first embodiment of the invention comprises a body 1, a pair of first supports 2, at least one brake 5, a transmission mechanism 7, a rotating shaft 8, multiple second supports 9, multiple linkage mechanisms, and a power mechanism 13.

The bottom of the body 1 is hinge connected to the first supports 2.

The first supports 2 and the second supports 9 are disposed on the ground.

The linkage mechanisms are hinge connected an upper part of the back of the body 1 and fixed on the rotating shaft 8, and operate to drive the body 1 to rotate with respect to the first supports 2.

The linkage mechanism comprises a connecting rod 11 and a rocker 12, and rotation of the rotation shaft 8 drives the rocker 12 and the connecting rod 11 to swing. In this embodiment, the number of the linkage mechanisms is 3.

One end of the connecting rod 11 is hinge connected an upper part of the back of the body 1, the other end of the connecting rod 11 is hinge connected to one end of the rocker 12, and the other end of the rocker 12 is fixed on the rotating shaft 8.

The brake 5 is disposed on one of the second supports 9 and operates to fix the rotating shaft 8. In this embodiment, the brake 5 is an electromagnetic brake.

The rotating shaft 8 abuts against one of the second supports 9.

The transmission mechanism 7 comprises a chain and a chain wheel engaged with each other.

The power mechanism 13 is fixed on the transmission mechanism 7 and operates to drive the rotating shaft 8 to rotate via the transmission mechanism 7. In this embodiment, the power mechanism 13 is a crank.

The connecting rod 11, the rocker 12, the body 1, and the first support 2 form a four-bar linkage. During operation, the power mechanism 13 drives the rotating shaft 8 to rotate via the transmission mechanism 7, at this time the rocker 12 and the connecting rod 11 swing and drive the body 1 to rotate from a vertical position to a horizontal position.

Figure 3:
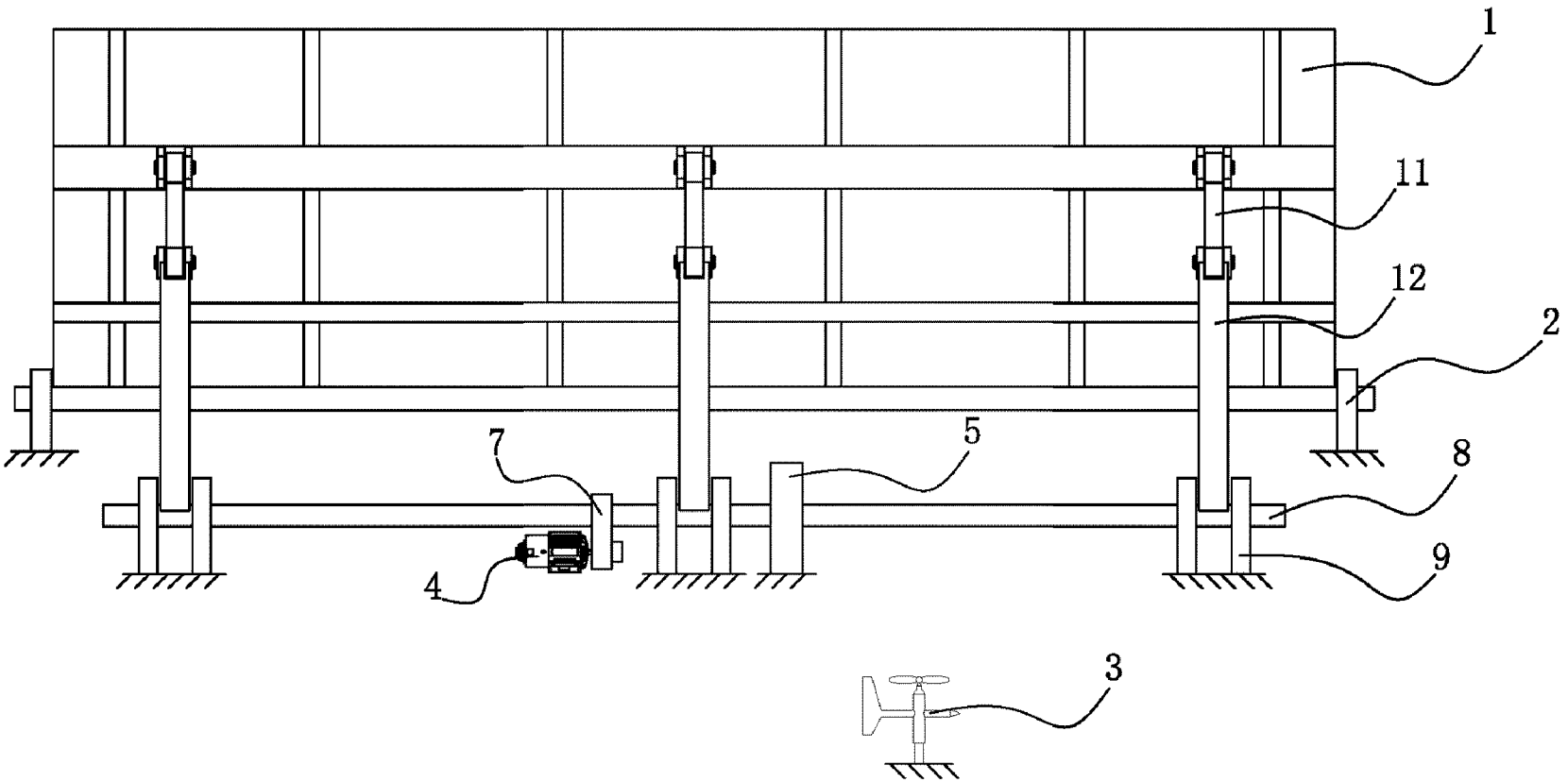
FIG. 3 is a schematic view of a windproof billboard of another exemplary embodiment of the invention.
Figure 4:
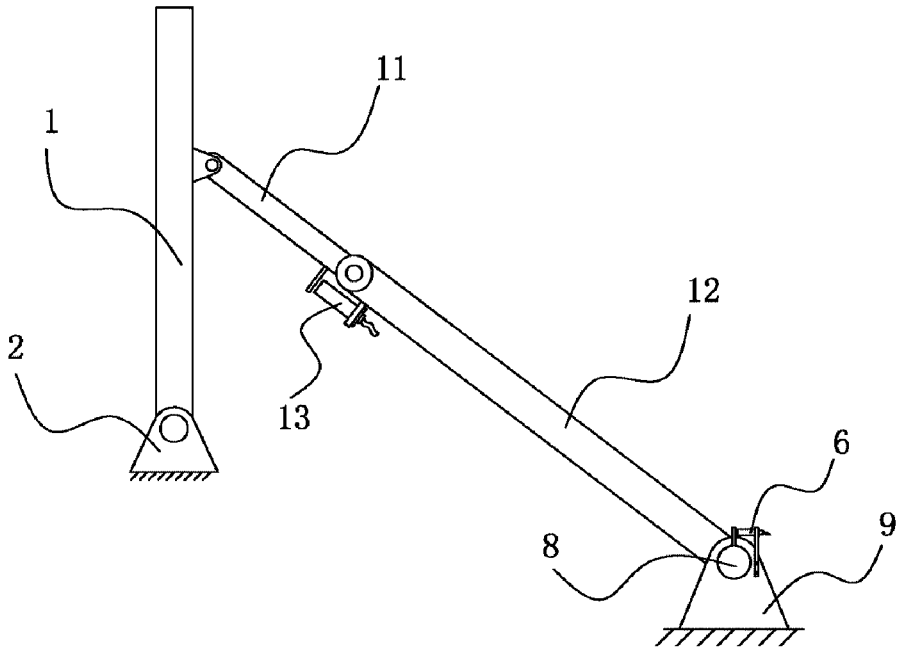
FIG. 4 is a side view of a body of a windproof billboard of FIG. 3 in a vertical position.
Figure 5:
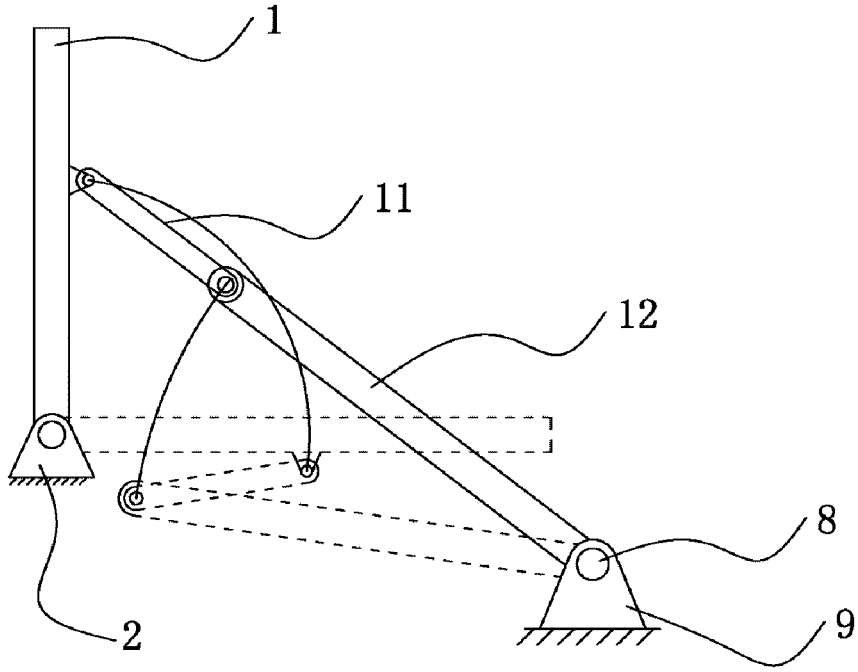
FIG. 5 is a side view of a body of a windproof billboard of FIG. 3 in a horizontal position.

As shown in FIGS. 3-5, a windproof billboard of a second embodiment of the invention comprises a body 1, a pair of first supports 2, an anemometer 3, a power mechanism 4, at least one brake 5, a first trigger switch 6, a transmission mechanism 7, a rotating shaft 8, multiple second supports 9, multiple linkage mechanisms, an electrical control device 10 (not shown), a second trigger switch 13, a first relay 41, and a second relay 42.

The bottom of the body 1 is hinge connected to the first supports 2.

The first supports 2 and the second supports 9 are disposed on the ground.

The linkage mechanisms are hinge connected an upper part of the back of the body 1 and fixed on the rotating shaft 8, and operate to drive the body 1 to rotate with respect to the first supports 2.

The linkage mechanism comprises a connecting rod 11 and a rocker 12, and rotation of the rotation shaft 8 drives the rocker 12 and the connecting rod 11 to swing. In this embodiment, the number of the linkage mechanisms is 3.

The first trigger switch 6 comprises a stopper 61 and a limit switch 62. The limit switch 62 is connected to the electrical control device 10, the stopper 61 is fixed on one of the body 1 and one of the second supports 9, and the limit switch 62 is fixed on the other one of the body 1 and one of the second supports 9.

One end of the connecting rod 11 is hinge connected an upper part of the back of the body 1, the other end of the connecting rod 11 is hinge connected to one end of the rocker 12, and the other end of the rocker 12 is fixed on the rotating shaft 8.

The anemometer 3 is disposed on the body 1 or on the ground, and operates to measures a wind velocity.

The brake 5 is disposed on one of the second supports 9 and operates to fix the rotating shaft 8. In this embodiment, the brake 5 is an electromagnetic brake.

The first trigger switch 6 is disposed between one of the second supports 9 and the body 2, and operates to detect whether the body 1 is in a horizontal position.

The transmission mechanism 7 comprises a chain and a chain wheel engaged with each other.

The rotating shaft 8 abuts against one of the second supports 9.

The electrical control device 10 is electrically connected to the brake 5, the power mechanism 4, the anemometer 3 and the first trigger switch 6, and operates to control the power mechanism 4 and the brake 5 according to a wind velocity measured by the anemometer 3 and a control signal of the first trigger switch 6.

The electrical control device 10 comprises a main control unit 101 and a signal conversion unit 102. The main control unit 101 is electrically connected to the brake 5, the power mechanism 4 and the first trigger switch 6, and the anemometer 3 is connected to the main control unit 101 via the signal conversion unit 102.

The power mechanism 4 fixed outside the rotating shaft 8 and operates to drive the rotating shaft 8 to rotate via the transmission mechanism 7. In this embodiment, the power mechanism 4 is a motor.

The first relay 41 operates to drive the power mechanism 4 to rotate forwardly, and the second relay 42 operates to drive the power mechanism 4 to rotate reversely, whereby enabling the windproof billboard to rotate and immediately return to an original position.

The connecting rod 11, the rocker 12, the body 1, and the first support 2 form a four-bar linkage. During operation, the power mechanism 4 drives the rotate 8 to rotate via the transmission mechanism 7, at this time the rocker 12 and the connecting rod 11 swing and drive the body 1 to rotate from a vertical position to a horizontal position.

The second trigger switch 13 is disposed between the connecting rod 11 and the rocker 12 and electrically connected to the electrical control device 10, and operates to detect whether the body 1 is in a vertical position.

Structure of the second trigger switch 13 is almost the same as that of the first trigger switch 6, except that a stopper of the second trigger switch 13 is disposed at a dead point of the four-bar linkage that is fully unfolded.

Figure 6:
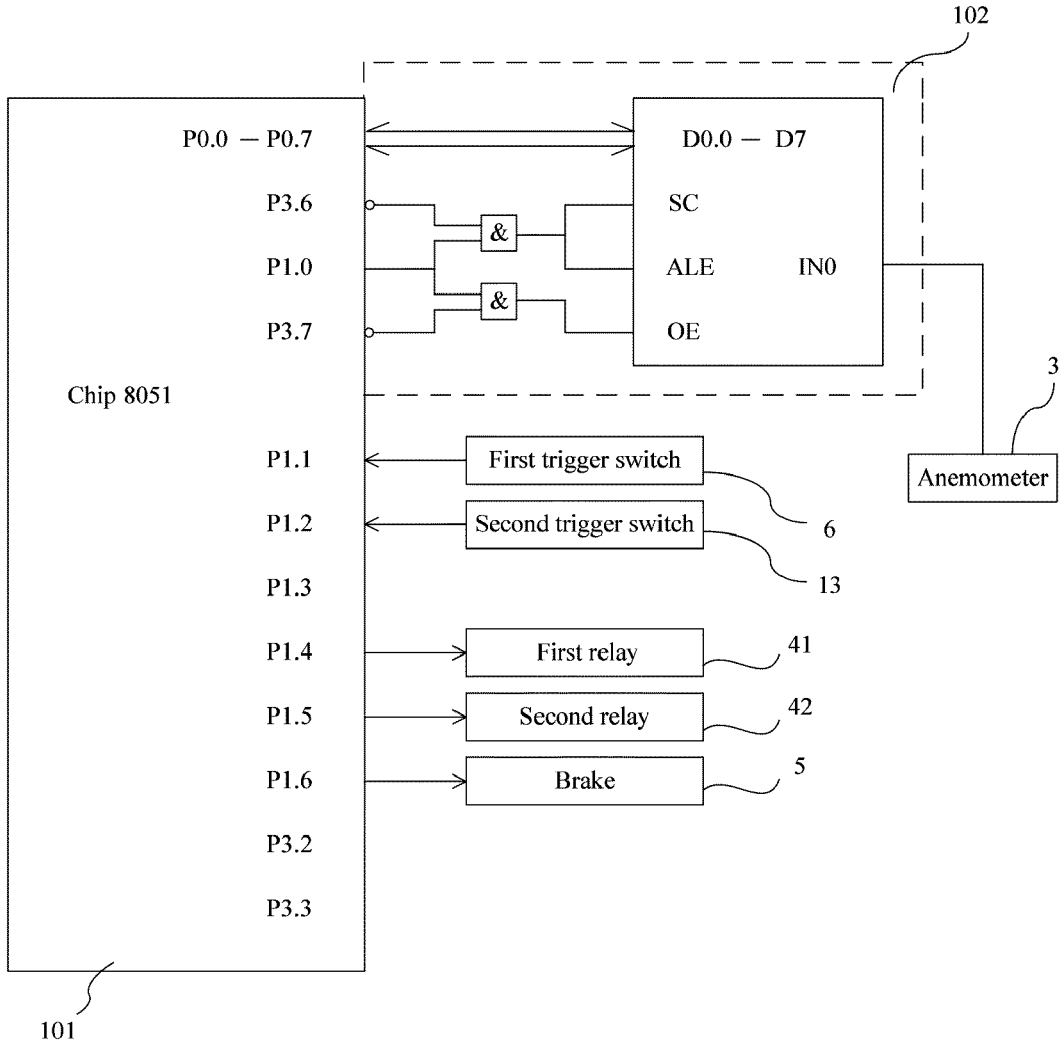
FIG. 6 illustrates an electrical control device of a windproof billboard of FIG. 3.

As shown in FIG. 6, the main control unit 101 is an 8051-type microprocessor chip. A pin P1.1 of the main control unit 101 is electrically connected to the first trigger switch 6, pins P1.4 and P1.5 thereof are electrically connected to the second trigger switch 13, a pin P1.6 thereof is electrically connected to the brake 5, a pin P1.3 is electrically connected to the first relay 41 and the second relay 42, and pins P0.0-P0.7, P3.6, P1.0, and P3.7 are electrically connected to the signal conversion unit 102.

The signal conversion unit 102 comprises an ADC0809-type converter, a first inverter, a second inverter, a first AND gate chip, and a second AND gate chip.

A pin IN0 of the converter is electrically connected to the anemometer 3, pins D0-D7 thereof are respectively electrically connected to pins P0.0-P0.7 of the main control unit 101.

The pin P3.6 of the main control unit 101 is electrically connected to the first inverter and then to an input end of the first AND gate chip, and the pin P1.0 thereof is electrically connected to the other input end of the first AND gate chip.

An output end of the first AND gate chip is connected to pins SC and ALE of the converter.

The pin P3.7 of the main control unit 101 is electrically connected to the second inverter and then to an input end of the second AND gate chip, and the pin P1.0 thereof is electrically connected to the other input end of the second AND gate chip.

An output end of the second AND gate chip is connected to a pin OE of the converter.

Operation principle of the windproof billboard of a second embodiment of the invention is as follows.

As shown in FIG. 2, under a normal weather condition, the body 1 is fixed in a vertical position. As a wind velocity is greater than a designed value, the anemometer 3 transmits a trigger signal to the electrical control device 10. The electrical control device 10 switches on the brake 5, and then the first relay 41 so that the rocker 12 and the body 1 rotate. As the body 1 reaches a horizontal position, the limit switch 62 disposed on the second support 9 is triggered and switches off the first relay 41 and then the brake 5. At this time the windproof billboard is fixed in the horizontal position, as shown in FIG. 3.

As the wind velocity is less than the designed value in a time interval, the electrical control device 10 switches on the brake 5 and then the second relay 42 so that the rocker 12 and the body 1 rotate. As the body 1 reaches a vertical position, the second trigger switch disposed between the connecting rod 11 and the rocker 12 is triggered and the electrical control device 10 switches off the second relay 42 and then the brake 5. At this time the windproof billboard is fixed in the vertical position.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A windproof billboard, comprising
a body;
a pair of first supports;
multiple second supports;
a rotating shaft;
multiple linkage mechanisms;
a transmission mechanism;
a power mechanism; and
at least one brake;
wherein
said first supports and said second supports are disposed on the ground;
the bottom of said body is hinge connected to said first supports;
said linkage mechanisms are hinge connected an upper part of the back of said body and fixed on said rotating shaft, and operate to drive said body to rotate with respect to said first supports;
said rotating shaft abuts against one of said second supports;
said power mechanism is fixed on said transmission mechanism and operates to drive said rotating shaft to rotate via said transmission mechanism; and
said brake is disposed on one of said second supports and operates to fix said rotating shaft.

2. The windproof billboard of claim 1, wherein
said linkage mechanism comprises a connecting rod and a rocker; and
rotation of said rotation shaft drives said rocker and said connecting rod to swing.

3. The windproof billboard of claim 2, wherein
one end of said connecting rod is hinge connected an upper part of the back of said body;
the other end of said connecting rod is hinge connected to one end of said rocker; and
the other end of said rocker is fixed on said rotating shaft.

4. The windproof billboard of claim 1, wherein said transmission mechanism comprises a chain and a chain wheel engaged with each other.

5. The windproof billboard of claim 1, wherein said brake is an electromagnetic brake.

6. The windproof billboard of claim 1, wherein said power mechanism is a crank.

7. A windproof billboard, comprising
a body;
a pair of first supports;
multiple second supports;
a rotating shaft;
multiple linkage mechanisms;
a transmission mechanism;
a power mechanism;
at least one brake;
a first trigger switch;
an anemometer;
an electrical control device; and wherein said first supports and said second supports are disposed on the ground;

the bottom of said body is hinge connected to said first supports;

said linkage mechanisms are hinge connected an upper part of the back of said body and fixed on said rotating shaft, and operate to drive said body to rotate with respect to said first supports;

said rotating shaft abuts against one of said second supports;

said power mechanism is fixed outside said rotating shaft and operates to drive said rotating shaft to rotate via said transmission mechanism;

said brake is disposed on one of said second supports and operates to fix said rotating shaft;

said anemometer is disposed on said body or on the ground, and operates to measures a wind velocity;

said first trigger switch is disposed between one of said second supports and said body, and operates to detect whether said body is in a horizontal position; and said electrical control device is electrically connected to said brake, said power mechanism, said anemometer and said first trigger switch, and operates to control said power mechanism and said brake according to a wind velocity measured by said anemometer and a control signal of said first trigger switch.

8. The windproof billboard of claim 7, wherein said linkage mechanism comprises a connecting rod and a rocker; and rotation of said rotation shaft drives said rocker and said connecting rod to swing.

9. The windproof billboard of claim 8, further comprising a second trigger switch disposed between said connecting rod and said rocker, electrically connected to said electrical control device, and operating to detect whether said body is in a vertical position.

10. The windproof billboard of claim 8, wherein one end of said connecting rod is hinge connected an upper part of the back of said body;

the other end of said connecting rod is hinge connected to one end of said rocker; and the other end of said rocker is fixed on said rotating shaft.

11. The windproof billboard of claim 7, wherein said transmission mechanism comprises a chain and a chain wheel engaged with each other.

12. The windproof billboard of claim 7, wherein said brake is an electromagnetic brake.

13. The windproof billboard of claim 7, wherein said power mechanism is a motor.

14. The windproof billboard of claim 7, wherein said first trigger switch comprises a stopper and a limit switch;

said limit switch is connected to said electrical control device;

said stopper is fixed on one of said body and one of said second supports; and said limit switch is fixed on the other one of said body and one of said second supports.

15. The windproof billboard of claim 7, wherein said electrical control device comprises a main control unit and a signal conversion unit;

said main control unit is electrically connected to said brake, said power mechanism and said first trigger switch; and said anemometer is connected to said main control unit via said signal conversion unit.

16. The windproof billboard of claim 7, further comprising a first relay and a second relay.

17. The windproof billboard of claim 16, wherein said first relay operates to drive said power mechanism to rotate forwardly; and said second relay operates to drive said power mechanism to rotate reversely.

* * * * *